US012110677B2

(12) United States Patent
Li et al.

(10) Patent No.: US 12,110,677 B2
(45) Date of Patent: Oct. 8, 2024

(54) SIDEWALL SYSTEM AND A COLLAPSIBLE BUILDING APPLIES THE SIDEWALL SYSTEM

(71) Applicant: A&C Future, Inc, Newport Beach, CA (US)

(72) Inventors: Sichen Li, Irvine, CA (US); Zhuangboyu Zhou, Santa Ana, CA (US); Jiuqi Wang, Tustin, CA (US); Ju Gao, Newport Beach, CA (US); Jiayang Qin, Newport Beach, CA (US); Han Qin, Newport Beach, CA (US); Xunmin Jiang, Irvine, CA (US)

(73) Assignee: A&C Future, Inc

( * ) Notice: Subject to any disclaimer, the term of this patent is extended or adjusted under 35 U.S.C. 154(b) by 191 days.

(21) Appl. No.: 17/980,457

(22) Filed: Nov. 3, 2022

(65) Prior Publication Data

US 2024/0151026 A1 May 9, 2024

(51) Int. Cl.
*E04B 1/344* (2006.01)
*E04B 1/343* (2006.01)

(52) U.S. Cl.
CPC ..... *E04B 1/3445* (2013.01); *E04B 1/34305* (2013.01); *E04B 1/34384* (2013.01)

(58) Field of Classification Search
CPC .. E04B 1/343; E04B 1/34317; E04B 1/34305; E04B 1/34384; E04B 1/3445; E04B 1/3442
See application file for complete search history.

(56) References Cited

U.S. PATENT DOCUMENTS 3,534,512 A * 10/1970 Ballas ..... E04H 1/12 52/143
8,381,452 B1 * 2/2013 Forsland ..... E04B 7/166 52/64
2012/0000141 A1 * 1/2012 Forsland ..... E04B 1/34305 52/66
2014/0311052 A1 * 10/2014 Farmer ..... E04B 1/343 52/79.5

FOREIGN PATENT DOCUMENTS

DE 3603118 A1 * 9/1987
GB 2568927 A * 6/2019 ..... E04B 1/34305
WO WO-2012127211 A1 * 9/2012 ..... E04B 1/343

* cited by examiner

*Primary Examiner* — Christine T Cajilig
(74) *Attorney, Agent, or Firm* — Elizabeth Yang

(57) ABSTRACT

The present invention provides a sidewall system and a collapsible building using the system thereof. The sidewall system has a fixed wall, a sidewall, and a single-side eave system that has an eave panel that can be unfolded and folded along with the movement of the sidewall automatically. A collapsible building with two sidewall systems and a sliding, retractable roof is also provided. The collapsible building can create an enclosed space easily and quickly.

12 Claims, 6 Drawing Sheets

SIDEWALL SYSTEM AND A COLLAPSIBLE BUILDING APPLIES THE SIDEWALL SYSTEM

FIELD OF THE INVENTION

The present invention generally relates to a sidewall system to be able to unfold and fold the eave panel on the top of the sidewall along with the movement of the sidewall automatically. More particularly, the present invention relates to a collapsible building with a sidewall system and a sliding, retractable roof on it.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The invention is a system of foldable walls and a collapsible building with the system of foldable walls and a retractable roof. The system can be used to create a stable shield or enclosed spaces that can be used in houses, RVs, warehouses, etc.

For fixed structures or for people using RVs for traveling, it is sometimes necessary to provide portable walls that can be easily opened to provide shade along the horizontal plane. Sometimes it is necessary to provide shade in both directions in the horizontal plane. Further, there is also a need to provide a shelving platform at the top of the wall to accommodate other items or devices such as solar panels, temporary sun/rain shades, etc. to be placed on its top. In the prior art, the portable wall is usually assembled in such a way that after the wall is built, the items or equipment to be installed on it is fixed to it. The disadvantage of this type of wall is that building two vertical walls at an angle to each other and the shelving plane on top of them requires several steps and sometimes the assistance of others. In many cases, the device installed on its top surface cannot be fixed effectively if the shelving plane is not secured. Therefore, it is necessary to provide a device/system that can automatically release the eaves at the top for the installation of the top device while the wall is opened.

Traditional methods of obtaining similar sized enclosed spaces are mainly tents and prefabricated mini warehouses. Prefabricated mini warehouses are large and difficult to transport; in order to reduce the weight of transportation, they usually use materials with low weight, such as plastic, which are not stable enough. Tents are small in the stowed state, but the structure is not strong enough to withstand larger loads, such as high wind pressure, snow, etc. When idle or transported, the present invention reduces its volume when idle or transported by foldable walls and retractable roof, and the material uses formwork with a steel frame to improve load-bearing capacity.

SUMMARY

Illustrative embodiments of the disclosure are generally directed to a sidewall system and a collapsible building with the sidewall system.

In one general aspect, the sidewall system may include a fixed wall. The sidewall system may also include a sidewall pivoted to the fixed wall, the sidewall rotates around the fixed wall about a pivoting axis. The system may furthermore include a single-side eave system attached to the sidewall, it may include: a gear rod, the gear rod is mounted and fixed to the fixed wall, the gear rod is coaxial with pivoting axis of the sidewall; an eave panel hinged to the sidewall, the eave panel rotates around hinge axis correspondingly; a gear, teeth of the gear and the gear rod engage with each other, the gear is attached to and coaxial with a drive shaft; where the drive shaft is rotatably mounted on the sidewall; and at least one support rod, one end of the support rod is slidably pivoted on the eave panel and another end is securely coupled to the drive shaft, the drive shaft rotates the support rod.

The single-side eave system may include 2 or more support rods.

The single-side eave system may include an outer cylindrical gear rod shell and an inner cylindrical gear rod shell, the outer cylindrical gear rod shell may be arranged on the fixed wall along the gear rod; the inner cylindrical gear rod shell may be arranged on the sidewall along the gear rod. The inner cylindrical gear rod shell may be shorter than the outer cylindrical gear rod shell in radius. The outer cylindrical gear rod shell and the inner cylindrical gear rod shell may jointly cover the gear rod.

The single-side eave system may include a ring gear shell. The ring gear shell may be mounted on the fixed wall. The space inside the ring gear shell may accommodate the gear when the gear is close to the fixed wall.

The single-side eave system may have at least one sleeve for the drive shaft, the sleeve may be fixed to the sidewall, the sleeve is coaxial with the drive shaft, and the sleeve defines a rotation space for the drive shaft therein.

The single-side eave system may have 2 or more sleeves, the sleeves may be fixed to the sidewall at equally spaced distances along the drive shaft axis.

Other embodiments of this aspect include corresponding apparatus, mechanisms, components, and elements.

In one general aspect, a collapsible building may include a first fixed wall. The collapsible building may also include a first sidewall pivoted to the first fixed wall; the first sidewall rotates around the first fixed wall about a first pivoting axis. The building may furthermore include a first single-side eave system may include a first eave panel hinged to the first sidewall, the first eave panel rotates around a first hinge axis correspondingly. The building may in addition include a second fixed wall. The building may moreover include a second sidewall pivoted to the second fixed wall; the second sidewall rotates around the second fixed wall about a second pivoting axis. The building may also include a second single-side eave system may include a second eave panel hinged to the second sidewall, the second eave panel rotates about a second hinge axis correspondingly. The building may furthermore include the first sidewall and the first fixed wall to form a first sidewall system in the open state, at which state angle between the first sidewall and the first fixed wall is 180. The building may, in addition, include the second sidewall and the second fixed wall to form a second sidewall system in the open state, at which state angle between the first sidewall and the first fixed wall is 180. The building may moreover include the first sidewall system and the second sidewall system in the open state facing each other. The building may also include a retractable roof that includes a plurality of roof sections that each span width of two sets of walls facing each other; some of the roof sections are fixed, and some of the roof sections are movable roof sections. The building may furthermore include where some movable sections are slidably mounted on the top surface of the first and second sidewall, the movable roof sections being moveable in a direction along the length of the wall set to convert the retractable roof between an open configuration and a closed configuration, some of the roof sections overlapping one another when the retractable roof is in the open configuration, the region between the first sidewall system and the second sidewall system is covered by the roof sections when the retractable roof is in the closed configuration.

The collapsible building may have a base plate. The first fixed wall and the second fixed wall may be connected by the base plate as one piece.

The collapsible building may have first roof tracks mounted on top, the movable roof sections may move along the first roof tracks to convert the retractable roof between the open configuration and the closed configuration. The second sidewall may have second roof tracks respectively. The second and the first roof tracks have the same configuration.

The collapsible building may have a first exterior wall firmly attached to the first fixed wall and the second fixed wall respectively, and a second exterior wall detachably connected to the first sidewall and the second sidewall respectively.

The collapsible building may have multi-lay nested roof sections.

The collapsible building may have 3 or more roof sections.

Other embodiments of this aspect include corresponding apparatus, mechanisms, components, and elements.

BRIEF DESCRIPTION OF THE DRAWINGS

The drawings illustrate examples. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Figure 1:
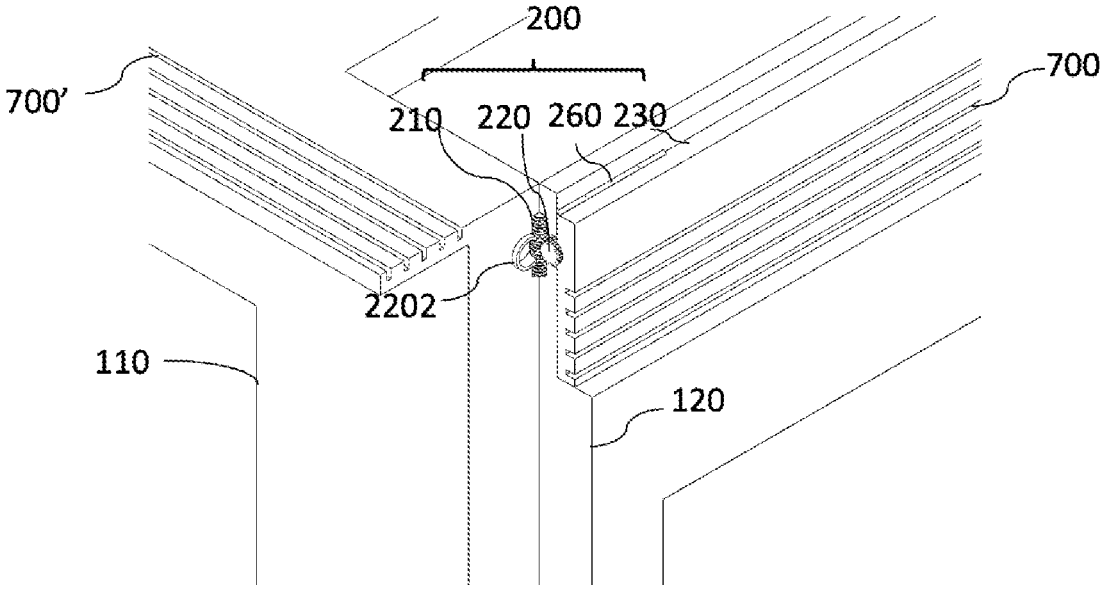
FIG. 1 shows the schematic view of the sidewall system.
Figure 2:
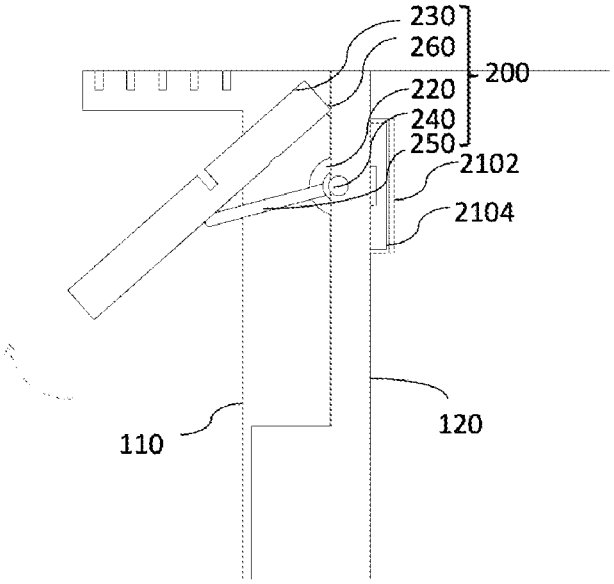
FIG. 2 shows the side view of the sidewall system while deploying

FIG. 1 and FIG. 2 show an embodiment of the sidewall system. FIG. 1 shows the folded status of the sidewall system. FIG. 2 shows the side view of the sidewall system while deploying from the folded status to the unfolded status as shown by the dashed arrow direction in FIG. 2. The sidewall system comprises a fixed wall 110, a sidewall 120, and a single-side eave system 200. The sidewall 120 is pivoted to the fixed wall 110 by one or several hinges, the sidewall 120 rotates in the horizontal plane around the hinge axis to unfold or fold the sidewall system.

The single-side eave system 200 is attached to the sidewall 120. The single-side eave system 200 comprises a gear rod 210, a gear 220, an eave panel 230, a drive shaft 240, at least one support rod 250, and at least one hinge 260. The eave panel 230 is attached to the sidewall 120 by one or more hinges 260. This configuration allows eave panel 230 to be rotated around the axis of hinge 260. As shown in FIG. 1, in the folded state, eave panel 230 and sidewall 120 are affixed together. As shown in FIG. 2, while deploying the eave panel 230 rotates around the hinge 260 axis correspondingly. In the fully unfolded status, the eave panel 230 is approximately perpendicular to the sidewall 120.

In the embodiment, the gear rod 210, the gear 220, and the support rod 250 constitute the mechanism that automatically unfolds and folds the eave panel 230 along with the movement of the sidewall 120 around the fixed wall 110. In this mechanism, the gear rod 210 is mounted and fixed to the fixed wall 110 without relative motion to the fixed wall 110 and cannot be rotated without a rotating shaft. The gear rod 210 is coaxial with the pivoting axis of the sidewall 120. The gear 220 is attached to and coaxial with a drive shaft 240 and does not have relative motion with the drive shaft 240. The teeth of gear 220 and gear rod 210 engage with each other. When sidewall 120 rotates, gear 220 rotates synchronously. Since gear 220 and drive shaft 240 are fixed and coaxially connected, the shaft rotates synchronously with gear 220. Since gear rod 210 is fixed, it remains stationary with respect to the fixed wall 110 during the rotation of the sidewall 120. Since gear 220 is located on the sidewall 120, during the rotation of the sidewall 120, gear 220 is forced to rotate simultaneously around its own axis to maintain the engagement with the teeth of the gear rod 210. Therefore, when sidewall 120 rotates, it drives gear 220 and drive shaft 240 to rotate simultaneously, and the rotation of drive 240 drives the rotation of support rod 250, which eventually drives the rotation of eave panel 230. The rotation of sidewall 120 in the horizontal plane drives the rotation of eave panel 230 in the vertical plane. As shown in FIG. 2, at least one support rod 250 connects the eave panel 230 and the drive shaft 240. One end of the support rod 250 is slidably pivoted on the eave panel 230 and the other end is securely coupled to the drive shaft 240. When the drive shaft 240 rotates, it drives the support rod 250 to prop up the eave panel 230. In the present embodiment, the rotation of sidewall 110 around fixed wall 110 drives the rotation of drive shaft 240, which in turn drives the support rod 250 to raise or retract the eave panel 230. In another embodiment, to provide more stable support, the single-side eave system 200 further comprises 2 or more support rods 250, the ends of each support rod 250 on one side are slidably pivoted on the eave panel 230, and the other ends are securely coupled to the drive shaft 240, the drive shaft 240 rotates all the support rods 250 synchronously.

Figure 3A:
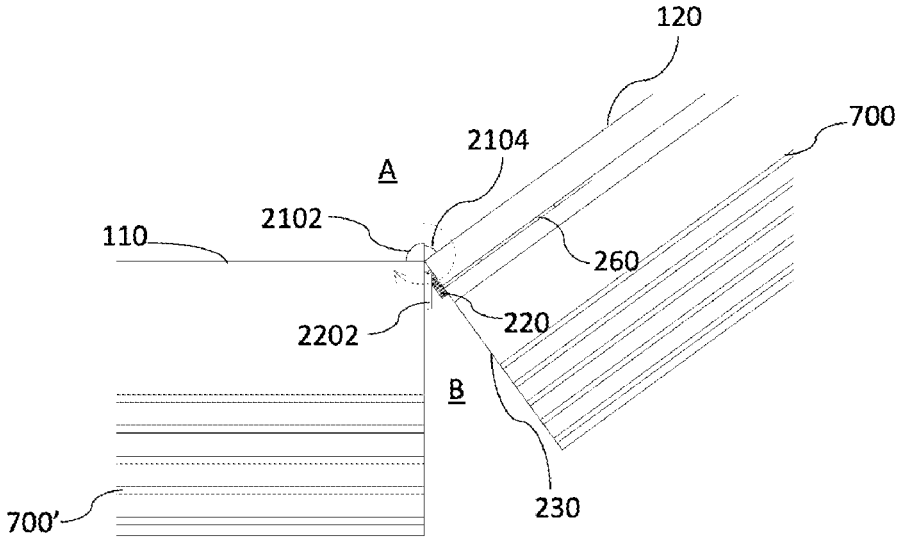
FIG. 3A and FIG. 3B show the top view and schematic of the sidewall system while deploying respectively.
Figure 3B:
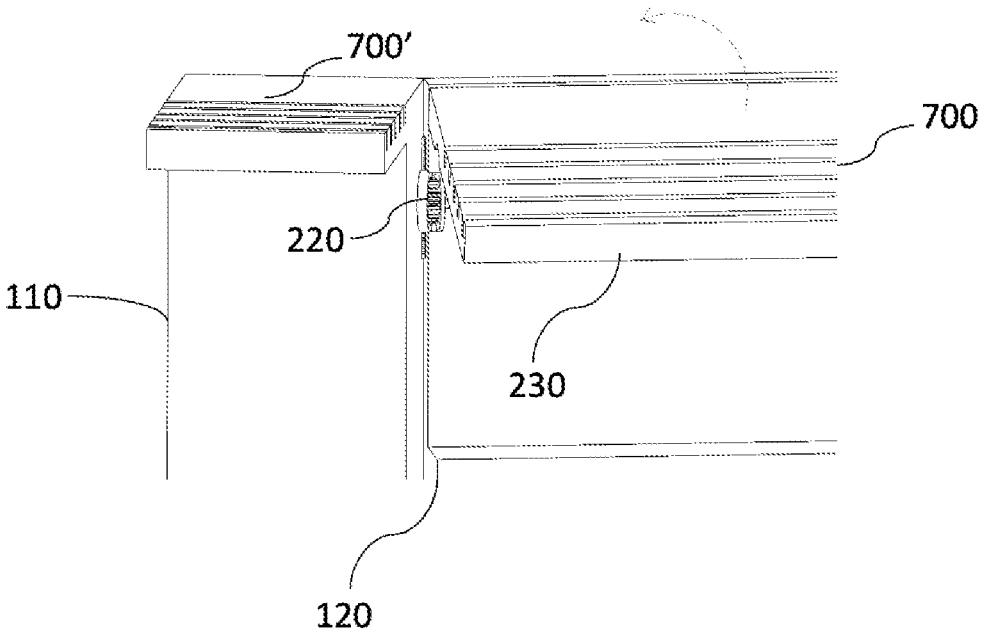

FIG. 3A and FIG. 3B show the top view and schematic of the sidewall system while deploying respectively. The direction of the arrow in FIG. 3A indicates the direction of rotation of sidewall 120. The direction of the arrow in FIG. 3B indicates the direction of rotation of eave panel 230.

To prevent the entry of external debris and water droplets to reduce the life of gear 220 and gear rod 21, the single-side eave system 200 further comprises shells for the gear rod and the gear.

In an embodiment, the shell for gear 220 comprises an outer cylindrical gear rod shell 2102 arranged on the fixed wall 110 along the gear rod 210 and an inner cylindrical gear rod shell 2104 arranged on the sidewall 120 along the gear rod 210. The outer cylindrical gear rod shell 2102 and the inner cylindrical gear rod shell 2104 are two separate components. The separate configuration facilitates the repair or replacement of individual shells in case of damage. Outer cylindrical gear rod shell 2102 is always fixed to the fixed wall 110 and remains relatively stationary. The inner cylindrical gear rod shell 2104 is always fixed to the sidewall 120 and turns at the same angle as the sidewall 120 rotates. As shown in FIG. 2 and FIG. 3A, the inner cylindrical gear rod shell 2104 is shorter than the outer cylindrical gear rod shell 2102 in radius. This setup allows the inner cylindrical gear rod shell 2104 to be partially covered by the outer cylindrical gear rod shell 2102 during rotation, thus avoiding jamming and providing better protection. The outer cylindrical gear rod shell 2102, and the inner cylindrical gear rod shell 2104 jointly cover the gear rod 210 located between Space A formed by the relative rotation of the fixed wall and the sidewall as FIG. 3A shows.

In another embodiment, the single-side eave system 200 includes a ring gear shell 2202. The ring gear shell 2202 is mounted on the fixed wall 110, space inside the ring gear shell 2202 accommodates the gear when gear 220 is close to the fixed wall 110 in Space B.

Figure 4A:
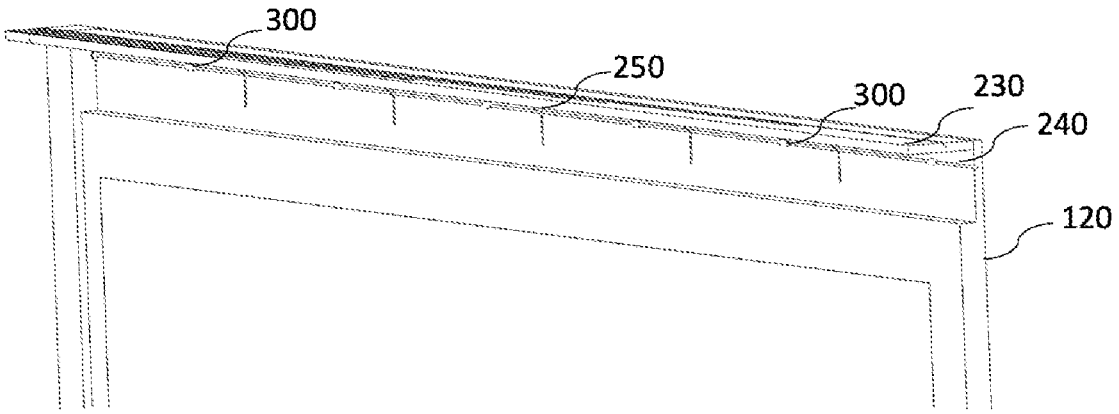
FIG. 4A and FIG. 4B show a plurality of fixing elements and a single fixing element.
Figure 4B:
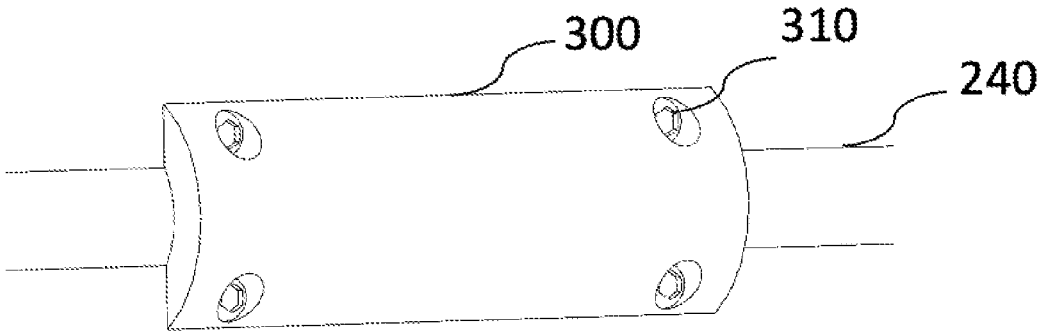

FIG. 4A and FIG. 4B show a plurality of fixing elements and a single fixing element. In order to provide better support for drive shaft 240, to make it rotate more smoothly, and to avoid bending, several fixing elements 300 have been installed. In an embodiment, 2 or more sleeves are applied as fixing elements, the sleeves 300 are fixed to the sidewall 120 at equally spaced distances along the axis of drive shaft 240. The fixing mechanism holds the drive shaft 240 in the long hole of sleeves 300 in the sidewall 120 so that the drive shaft 240 can rotate in the hole but cannot be disengaged from the hole. The fixing element 300 limits the position of the drive shaft 240. In an embodiment, the fixing element 300 is fixed to the sidewall 120 by four screws 310.

Figure 5A:
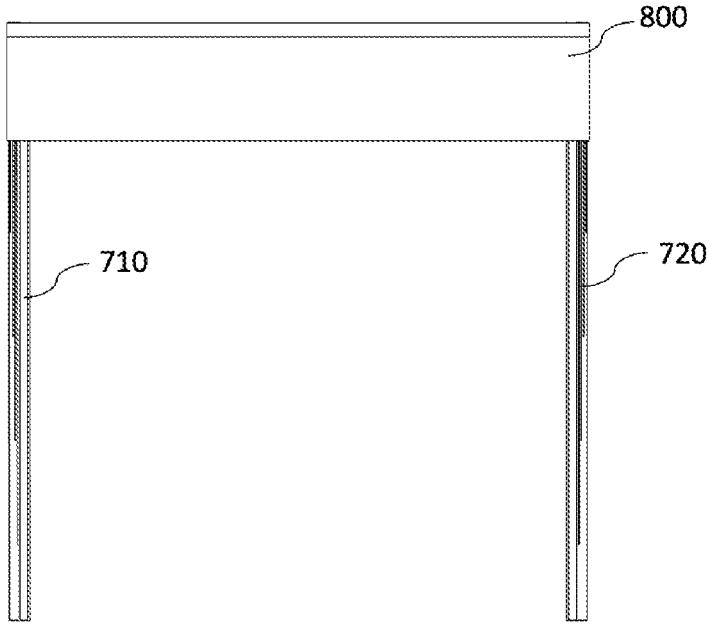
FIG. 5A and FIG. 5B show the top view and schematic view of a collapsible building when the sidewall system is fully deployed.
Figure 5B:
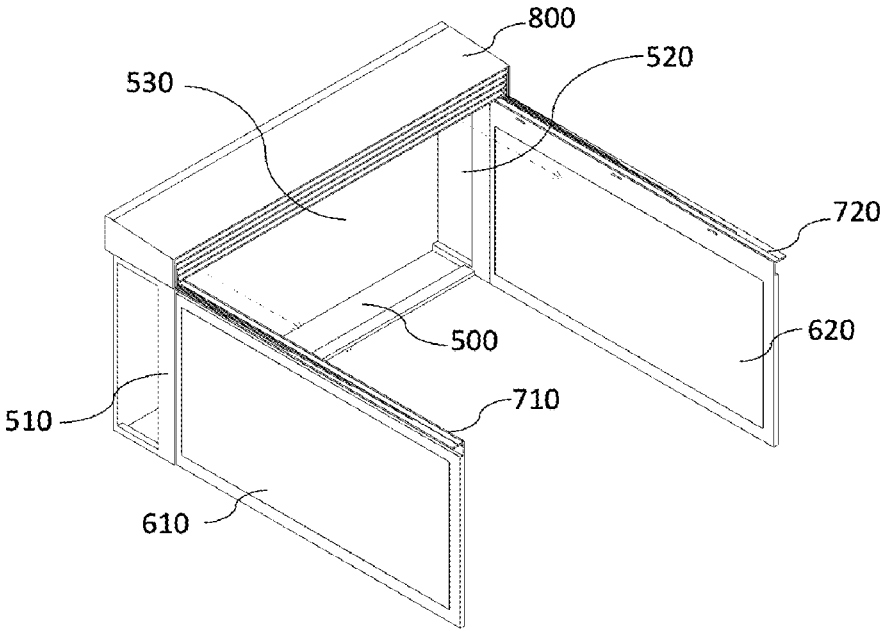
Figure 6A:
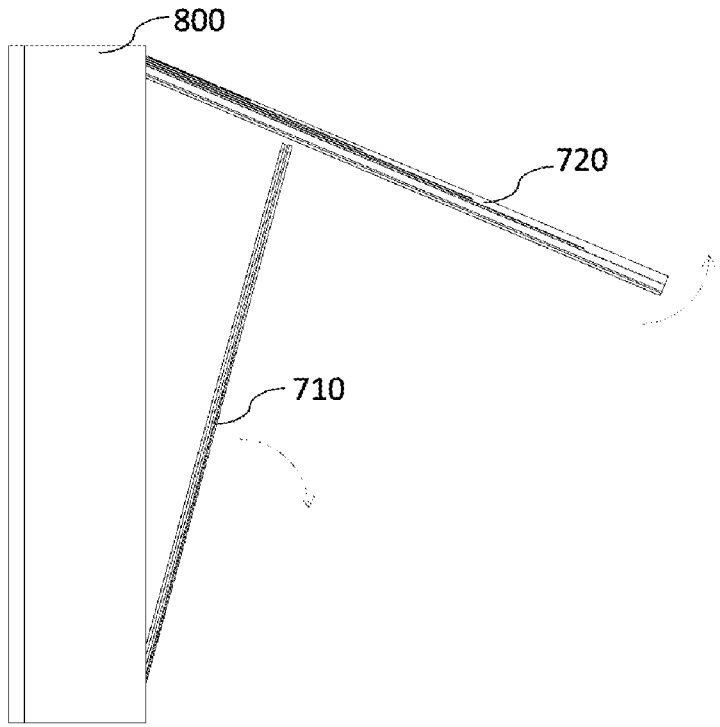
FIG. 6A and FIG. 6B show the top view and schematic view of a collapsible building while deploying from the folded status to the unfolded status.
Figure 6B:
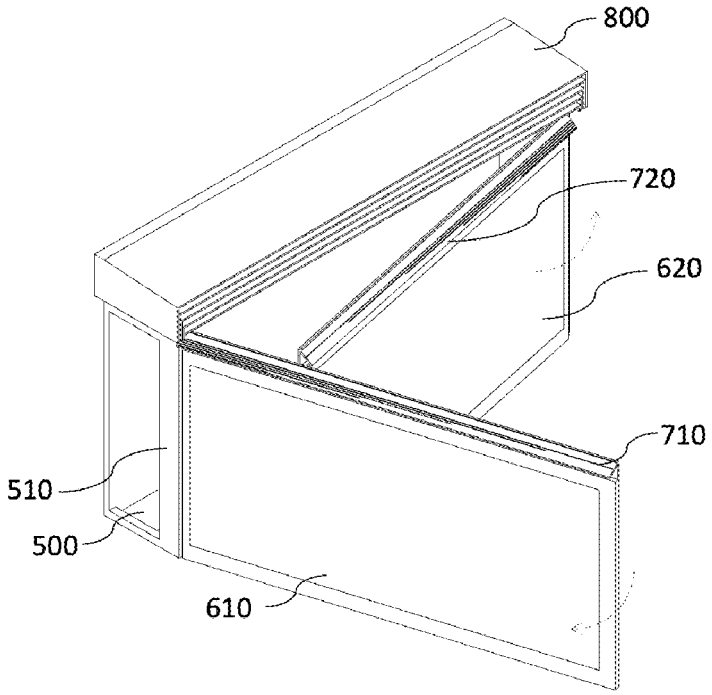

Another embodiment is shown in FIGS. 5A-6B. FIG. 5A and FIG. 5B show the top view and schematic view of a collapsible building when the sidewall system is fully deployed. FIG. 6A and FIG. 6B show the top view and schematic view of a collapsible building while deploying from the folded status to the unfolded status. The collapsible building comprises two previously mentioned sidewall systems and a retractable roof system.

More specifically, as shown in FIGS. 5A-6B, the building comprises a first sidewall system, a second sidewall system, and a retractable roof system. The first sidewall system comprises a first fixed wall 510; a first sidewall 610 pivoted to the first fixed wall 510, the first sidewall 610 rotates around the first fixed wall 510 about a first pivoting axis; a first single-side eave system comprises a first eave panel 710 hinged to the first sidewall 520, the first eave panel 710 rotates around a first hinge axis correspondingly.

The first single-side eave system is attached to the first sidewall 610. The first single-side eave system comprises a first gear rod, a first gear, a first eave panel 710, a first drive shaft, at least one first support rod, and at least one first hinge. The first eave panel 710 is attached to the first sidewall 610 by one or more first hinges. This configuration allows first eave panel 710 to be rotated around the axis of first hinge. In the folded state, first eave panel 710 and first sidewall 610 are affixed together. While deploying the first eave panel 710 rotates around the first hinge axis correspondingly. In the fully unfolded status, the first eave panel 710 is approximately perpendicular to the first sidewall 610.

In the embodiment, the first gear rod, the first gear, and the first support rod constitute the mechanism that automatically unfolds and folds the first eave panel 710 along with the movement of the first sidewall 610 around the first fixed wall 510. In this mechanism, the first gear rod is mounted and fixed to the first fixed wall 510 without relative motion to the first fixed wall 510 and cannot be rotated without a rotating shaft. The first gear rod is coaxial with the pivoting axis of the first sidewall 610. The first gear is attached to and coaxial with a first drive shaft and does not have relative motion with the first drive shaft. The teeth of first gear and first gear rod engage with each other. When first sidewall 610 rotates, first gear rotates synchronously. Since first gear and first drive shaft are fixed and coaxially connected, the shaft rotates synchronously with first gear. Since first gear rod is fixed, it remains stationary with respect to the first fixed wall 510 during the rotation of the first sidewall 610. Since first gear is located on the first sidewall 610, during the rotation of the first sidewall 610, first gear is forced to rotate simultaneously around its own axis to maintain the engagement with the teeth of the first gear rod. Therefore, when first sidewall 610 rotates, it drives first gear and first drive shaft to rotate simultaneously, and the rotation of the first drive shaft drives the rotation of first support rod, which eventually drives the rotation of first eave panel 710. The rotation of first sidewall 610 in the horizontal plane drives the rotation of first eave panel 710 in the vertical plane. At least one first support rod connects the first eave panel 710 and the first drive shaft. One end of the first support rod is slidably pivoted on the first eave panel 710 and the other end is securely coupled to the first drive shaft. When the first drive shaft rotates, it drives the first support rod to prop up the first eave panel 710. In the present embodiment, the rotation of the first sidewall 610 around first fixed wall 510 drives the rotation of first drive shaft, which in turn drives the first support rod to raise or retract the first eave panel 710. In another embodiment, to provide more stable support, the first single-side eave system further comprises 2 or more support rods, the ends of each first support rod on one side are slidably pivoted on the first eave panel 710, and the other ends are securely coupled to the first drive shaft, the first drive shaft rotates all the support rods synchronously.

Similar to those described previously, in the present embodiment, the rotation of the first sidewall 610 around fixed wall 510 drives the rotation of the drive shaft, which in turn drives the support rods to raise or retract the first eave panel 710. The first sidewall 610 and the first fixed wall 510 form a first sidewall system in the open state, at which the state angle between the first sidewall 610 and the first fixed wall 510 is 180°.

The second sidewall system is configured in the same way as the first sidewall system. The first sidewall system and the second sidewall system in the open state are facing each other.

Figure 7A:
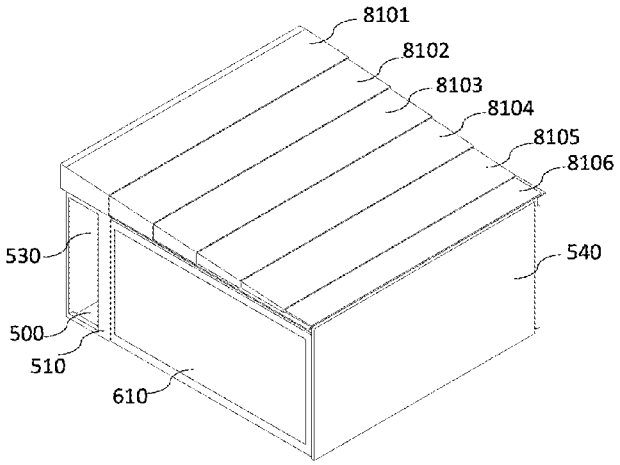
FIG. 7A, FIG. 7B, and FIG. 7C show the schematic, top view, and side view of a collapsible building when the top of the building is fully covered by the retractable roof.
Figure 7B:
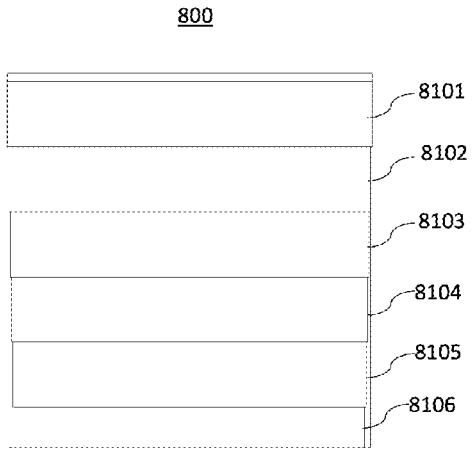
Figure 7C:
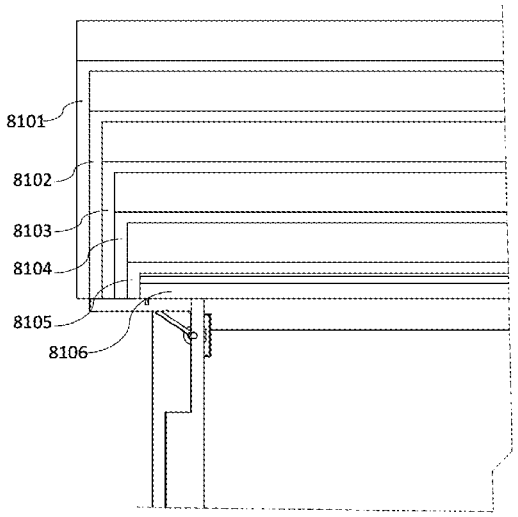

FIG. 7A, FIG. 7B, and FIG. 7C show the schematic, top view, and side view of a collapsible building when the top of the building is fully covered by the retractable roof. The retractable roof 800 includes a plurality of roof sections that each span width of two sidewall systems facing each other; some of the roof sections are fixed, and some of the roof sections are movable roof sections. The movable sections 8102, 8103, 8104, 8105, and 8106 are slidably mounted on top surface of the first and second sidewalls, the movable roof sections 8102, 8103, 8104, 8105, and 8106 being moveable in a direction along the length (as the direction shown in FIG. 5 B) of the two sidewall systems to convert the retractable roof 800 between an open configuration (as shown in FIGS. 5A and 5B) and a closed configuration (as shown in FIGS. 7A and 7B), some of the roof sections overlapping one another when the retractable roof 800 is in the open configuration, the region between the first sidewall system and the second sidewall system is covered by the roof sections when the retractable roof 800 is in the closed configuration.

In another embodiment, for smoother sliding and more precise positioning of the roof assembly, there are roof tracks mounted on top of the side walls. The roof sections deploy along the roof tracks. In FIG. 1, FIGS. 3A, and 3B the roof tracks are illustrated with the number 700. FIGS. 5A-6B show the first roof tracks mounted on the top of the first sidewall 520, and the second roof tracks mounted on the top of the second sidewall 620. The movable roof sections move along the first and the second roof tracks to convert the retractable roof 800 between the open configuration and the closed configuration. Thus, the size of the roof covering can be adjusted. In another embodiment, roof tracks 700' are set on the top of fixed walls. Tracks 700 and tracks 700' are aligned with each other so the roof sections can slide from the fixed wall to the sidewall along the tracks.

In another embodiment, the first fixed wall 510 and the second fixed wall 520 are connected by a base plate 500 as one piece to make the building more stable. In another embodiment, the collapsible building further comprises a first exterior wall 530 firmly attached to the first fixed wall 510 and the second fixed wall 520 respectively; and a second exterior wall 540 detachably connected to the first sidewall 610 and the second sidewall 620 respectively. In this case, the building provides better shelter and has a sliding roof.

In another embodiment, to improve better rain protection, wherein the roof sections are multi-layer nested. The number of its nesting is determined by the specific size. In another embodiment, the number of roof sections is 3 or more.

In another embodiment, the dimensions of the roof sections are sequentially increasing and nested so that they can be easily extended and stored. FIGS. 7A, 7B, and 7C show clearly that the roof section size decreases sequentially from 8101 to 8106.

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The foregoing disclosure provides illustration and description but is not intended to be exhaustive or to limit the implementations to the precise form disclosed. Modifications may be made in light of the above disclosure or may be acquired from practice of the implementations. As used herein, the term "component" is intended to be broadly construed as hardware, firmware, or a combination of hardware and software. It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein. As used herein, satisfying a threshold may, depending on the context, refer to a value being greater than the threshold, greater than or equal to the threshold, less than the threshold, less than or equal to the threshold, equal to the threshold, and/or the like, depending on the context. Although particular combinations of features are recited in the claims and/or disclosed in the specification, these combinations are not intended to limit the disclosure of various implementations. In fact, many of these features may be combined in ways not specifically recited in the claims and/or disclosed in the specification.

Although each dependent claim listed below may directly depend on only one claim, the disclosure of various implementations includes each dependent claim in combination with every other claim in the claim set. No element, act, or instruction used herein should be construed as critical or essential unless explicitly described as such. Also, as used herein, the articles "a" and "an" are intended to include one or more items and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, a combination of related and unrelated items, and/or the like), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A sidewall system, comprising:

a fixed wall;

a sidewall pivoted to the fixed wall, the sidewall rotates around the fixed wall about a pivoting axis; and a single-side eave system attached to the sidewall comprises:

a gear rod, the gear rod is mounted and fixed to the fixed wall, the gear rod is coaxial with pivoting axis of the sidewall;

an eave panel hinged to the sidewall, the eave panel rotates around hinge axis correspondingly;

a gear, teeth of the gear and the gear rod engage with each other, the gear is attached to and coaxial with a drive shaft; wherein the drive shaft is rotatably mounted on the sidewall; and at least one support rod, one end of the support rod is slidably pivoted on the eave panel and another end is securely coupled to the drive shaft, the drive shaft rotates the support rod.

2. The sidewall system of claim 1, wherein the amount of the support rods is 2 or more.

3. The sidewall system of claim 1, wherein the single-side eave system comprises:

an outer cylindrical gear rod shell, the outer cylindrical gear rod shell is arranged on the fixed wall along the gear rod;

an inner cylindrical gear rod shell, the inner cylindrical gear rod shell is arranged on the sidewall along the gear rod; and wherein, the inner cylindrical gear rod shell is shorter than the outer cylindrical gear rod shell in radius; the outer cylindrical gear rod shell, and the inner cylindrical gear rod shell jointly cover the gear rod.

4. The sidewall system of claim 1, wherein the single-side eave system includes a ring gear shell; and the ring gear shell is mounted on the fixed wall, space inside the ring gear shell accommodates the gear when the gear is close to the fixed wall.

5. The sidewall system of claim 1, wherein the single-side eave system includes at least one sleeve for the drive shaft, the sleeve is fixed to the sidewall, the sleeve is coaxial with the drive shaft, and the sleeve defines a rotation space for the drive shaft therein.

6. The sidewall system of claim 5, wherein the single-side eave system comprises 2 or more sleeves, the sleeves are fixed to the sidewall at equally spaced distances along drive shaft axis.

7. A collapsible building comprising:

a first fixed wall;

a first sidewall pivoted to the first fixed wall, the first sidewall rotates around the first fixed wall about a first pivoting axis;

a first single-side eave system comprises a first eave panel hinged to the first sidewall, the first eave panel rotates around a first hinge axis correspondingly;

a second fixed wall;

a second sidewall pivoted to the second fixed wall, the second sidewall rotates around the second fixed wall about a second pivoting axis;

a second single-side eave system comprises a second eave panel hinged to the second sidewall, the second eave panel rotates about a second hinge axis correspondingly;

the first fixed wall, the first sidewall, and the first single-side eave system form a first sidewall system in open state, at which state angle between the first sidewall and the first fixed wall is 180°;

the second fixed wall, the second sidewall, and the second single-side eave system form a second sidewall system in open state, at which state angle between the second sidewall and the second fixed wall is 180°;

the first sidewall system and the second sidewall system in the open state are facing each other;

a retractable roof includes a plurality of roof sections that each span width of the first sidewall system and the second sidewall system facing each other; some of the roof sections are fixed, and some of the roof sections are movable roof sections; and wherein some movable sections are slidably mounted on top surface of the first and second sidewall, the movable roof sections being moveable in a direction along length of the wall set to convert the retractable roof between an open configuration and a closed configuration, some of the roof sections overlapping one another when the retractable roof is in the open configuration, region between the first sidewall system and the second sidewall system is covered by the roof sections when the retractable roof is in the closed configuration.

8. The collapsible building of claim 7, wherein the first fixed wall and the second fixed wall are connected by a base plate as one piece.

9. The collapsible building of claim 7, wherein the first sidewall includes first roof tracks mounted on top, the movable roof sections move along the first roof tracks to convert the retractable roof between the open configuration and the closed configuration; and the second sidewall includes second roof tracks respectively.

10. The collapsible building of claim 7, further includes:

a first exterior wall firmly attached to the first fixed wall and the second fixed wall respectively; and, a second exterior wall detachably connected to the first sidewall and the second sidewall respectively.

11. The collapsible building of claim 7, wherein the roof sections are multi-layer nested.

12. The collapsible building of claim 7, wherein amount of the roof sections is 3 or more.

* * * * *